US007443347B2

(12) United States Patent
Mei

(10) Patent No.: US 7,443,347 B2
(45) Date of Patent: Oct. 28, 2008

(54) ANTENNA WITH COUPLING FEEDING

(75) Inventor: Chia-Hao Mei, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 19 days.

(21) Appl. No.: 11/617,768

(22) Filed: Dec. 29, 2006

(65) Prior Publication Data

US 2008/0094284 A1 Apr. 24, 2008

(30) Foreign Application Priority Data

Oct. 18, 2006 (CN) ..... 2006 1 0063154

(51) Int. Cl.
*H01Q 1/38* (2006.01)

(52) U.S. Cl. ..... 343/700 MS; 343/895

(58) Field of Classification Search ..... 343/700 MS, 343/702, 846, 895
See application file for complete search history.

(56) References Cited

U.S. PATENT DOCUMENTS 5,861,854 A * 1/1999 Kawahata et al. ..... 343/702
5,903,240 A * 5/1999 Kawahata et al. ..... 343/700 MS
6,861,988 B2 3/2005 Gabriel et al.

* cited by examiner

*Primary Examiner*—Hoang V Nguyen
(74) *Attorney, Agent, or Firm*—Wei Te Chung

(57) ABSTRACT

An antenna (10) is provided. The antenna (10) with coupling feeding, printed on a substrate (30) for transceiving electromagnetic signals. The antenna includes a radiator (12), a feeding portion (14), and a grounded portion (16). The radiator is for the transceiving electromagnetic signals. The feeding portion defines a gap with the radiator for coupling feeding the electromagnetic signals to the radiator via the gap. The grounded portion is disposed adjacent to the feeding portion.

10 Claims, 15 Drawing Sheets

ANTENNA WITH COUPLING FEEDING

BACKGROUND OF THE INVENTION

1. Field of the Invention

The present invention relates to antennas in wireless communication, and more particularly to an antenna with coupling feeding.

2. Description of Related Art

An antenna is a necessary component for a network device, such as an access point or a wireless router, operating according to the IEEE 802.11b standard or other standards. Some manufacturers in the art use a microstrip line, to act as an antenna for radiating wireless signals. The antenna conventionally feeds the electromagnetic signals by directly connecting a feeding portion of the antenna to the radiating portion of the antenna, and that causes the size of the antenna to be large.

Therefore, a need exists in the industry for an antenna that has a compact size.

SUMMARY OF THE INVENTION

One aspect of the present invention provides an antenna with coupling feeding, printed on a substrate for transceiving electromagnetic signals. The antenna includes a radiator, a feeding portion, and a grounded portion. The radiator is in a mazelike shape and is for transceiving the electromagnetic signals. The feeding portion defines a gap with the radiator for coupling feeding the electromagnetic signals to the radiator via the gap. The grounded portion is disposed adjacent to the feeding portion.

Other objectives, advantages and novel features of the present invention will be drawn from the following detailed description of preferred embodiments of the present invention with the attached drawings, in which:

DETAILED DESCRIPTION OF THE INVENTION

Figure 1:
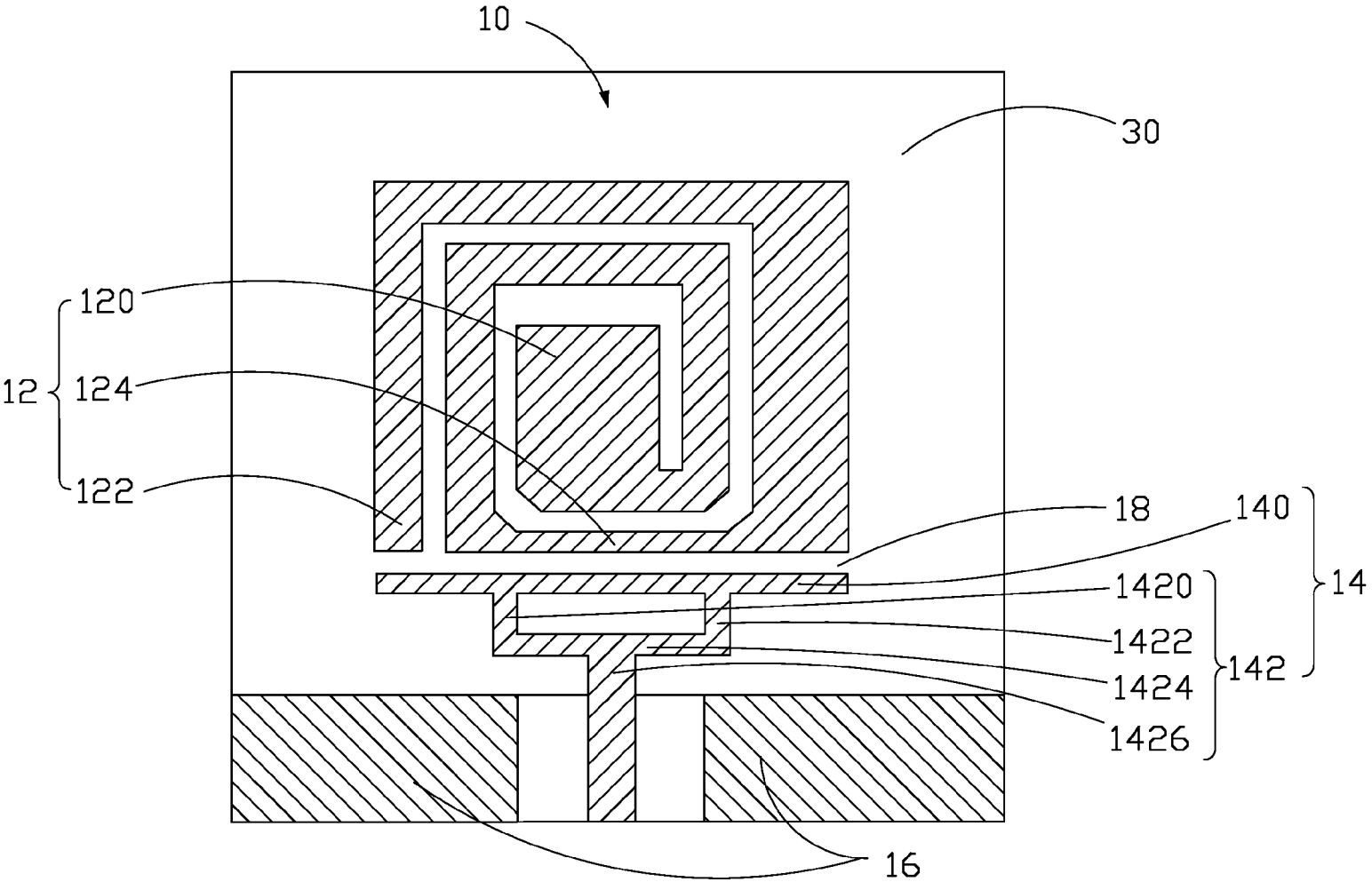
FIG. 1 is a top plan view of an antenna in accordance with an exemplary embodiment of the present invention.

FIG. 1 is a top plan view of an antenna 10 in accordance with an exemplary embodiment of the present invention.

The antenna 10 is a monopole antenna with coupling feeding, and is printed on a substrate 30 for transceiving electromagnetic signals. The antenna includes a radiator 12, a feeding portion 14, and two grounded portions 16.

In this exemplary embodiment, the radiator 12 has a mazelike structure with squared corners but can have rounded corners in other embodiments.

The radiator 12 includes a first radiating portion 120, a second radiating portion 122, and a connecting portion 124. The first radiating portion 120, the connecting portion 124, and the second radiating portion 122 are connected end to end to form the mazelike structure.

The feeding portion 14 includes a coupling portion 140 and a transmission portion 142.

The coupling portion 140 is disposed parallel to the radiator 12 and defines a gap 18 therewith. In this exemplary embodiment, the coupling portion 140 is disposed parallel to the connecting portion 124, and defines the gap 18 therewith. When the radiator 12 is structured with rounded corners, the coupling portion 140 is in an arc shape.

The transmission portion 142 is electronically connected to the coupling portion 140, and includes a first transmission line 1420, a second transmission line 1422, a third transmission line 1424, and a fourth transmission line 1426. The first transmission line 1420 is electronically connected to the coupling portion 140, the second transmission line 1422 is electronically connected to the coupling portion 140, and is disposed parallel to the first transmission line 1420. The third transmission line 1424 is electronically connected to the first transmission line 1420 and the second transmission line 1422, the fourth transmission line 1426 is electronically connected to the third transmission line 1424, and is disposed between the grounded portions 16. The grounded portions 16 being disposed at opposite ends of a same side of the antenna 10.

In other exemplary embodiments, the transmission portion 16 can only employ the fourth transmission line 1426 to directly feed the electromagnetic signals to the radiator 12.

Figure 2:
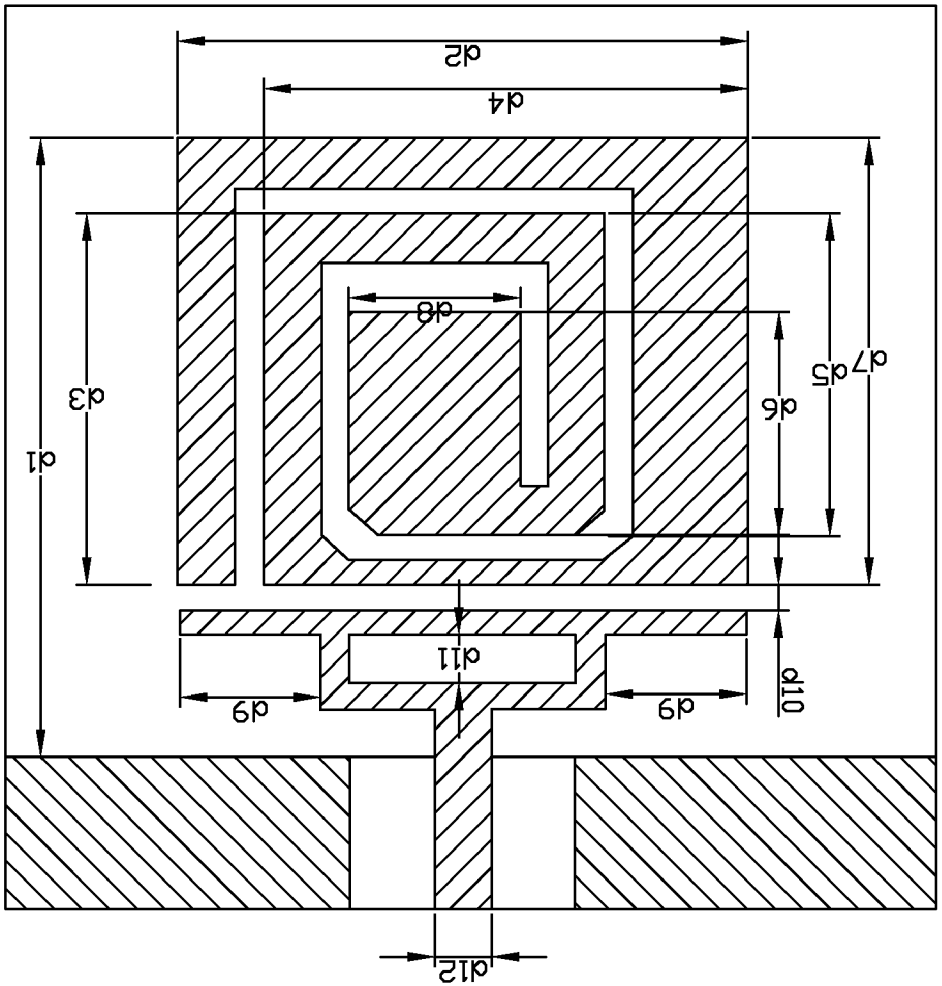
FIG. 2 shows parameters of the antenna of FIG. 1.

FIG. 2 shows parameters of the antenna 10 of FIG. 1.

In the present embodiment, d1, d2, d3, d4, d5, d6, d7, d8 d9, d10, d11, and d12 are 12.5 mm, 10 mm, 7.5 mm, 8.5 mm, 6.0 mm, 4.5 mm, 8.0 mm, 2.5 mm, 2.5 mm, 0.5 mm, 1.0 mm, and 1.0 mm respectively.

Figure 3:
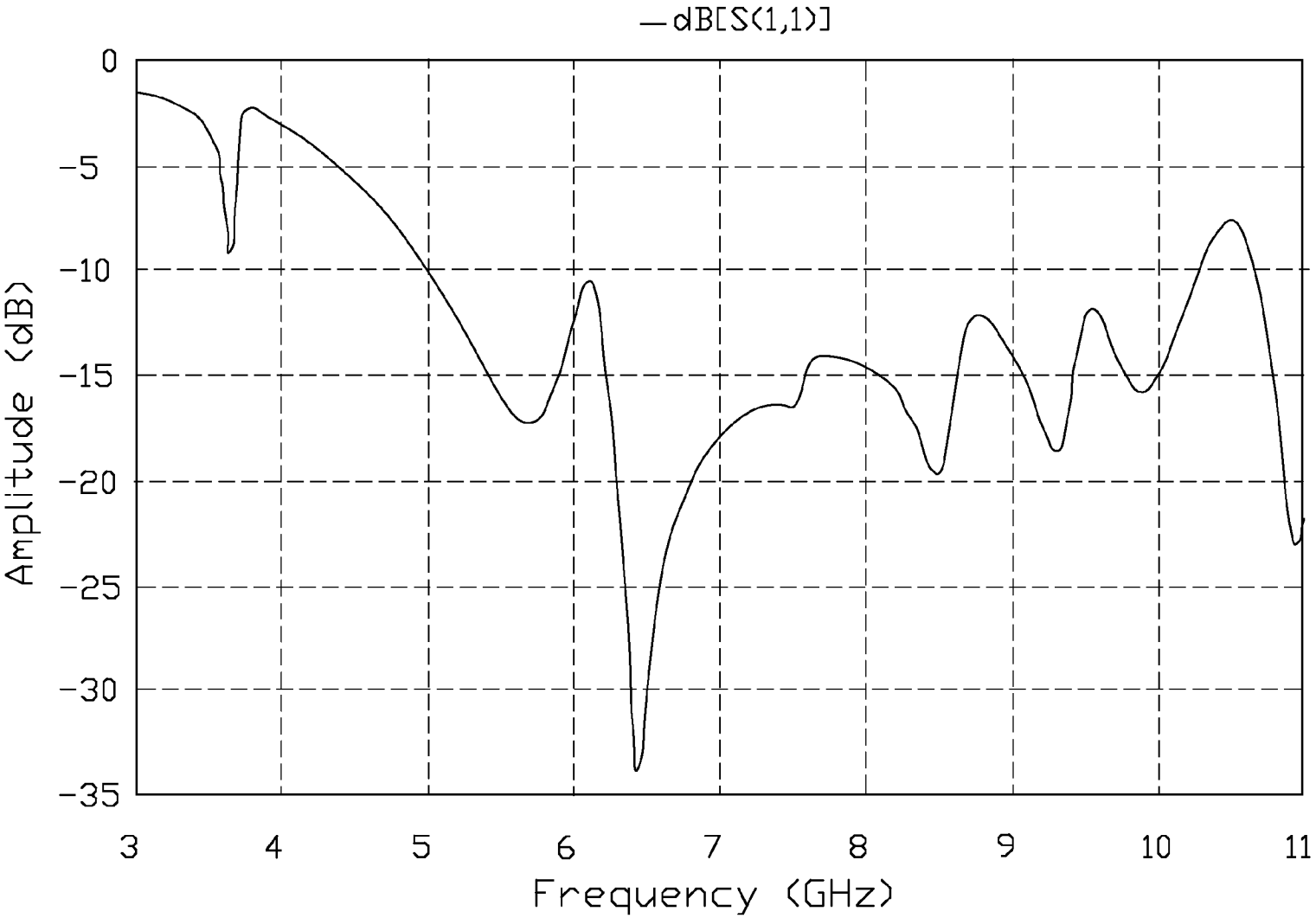
FIG. 3 is a graph showing return loss of the antenna of FIG. 1.
Figure 4:
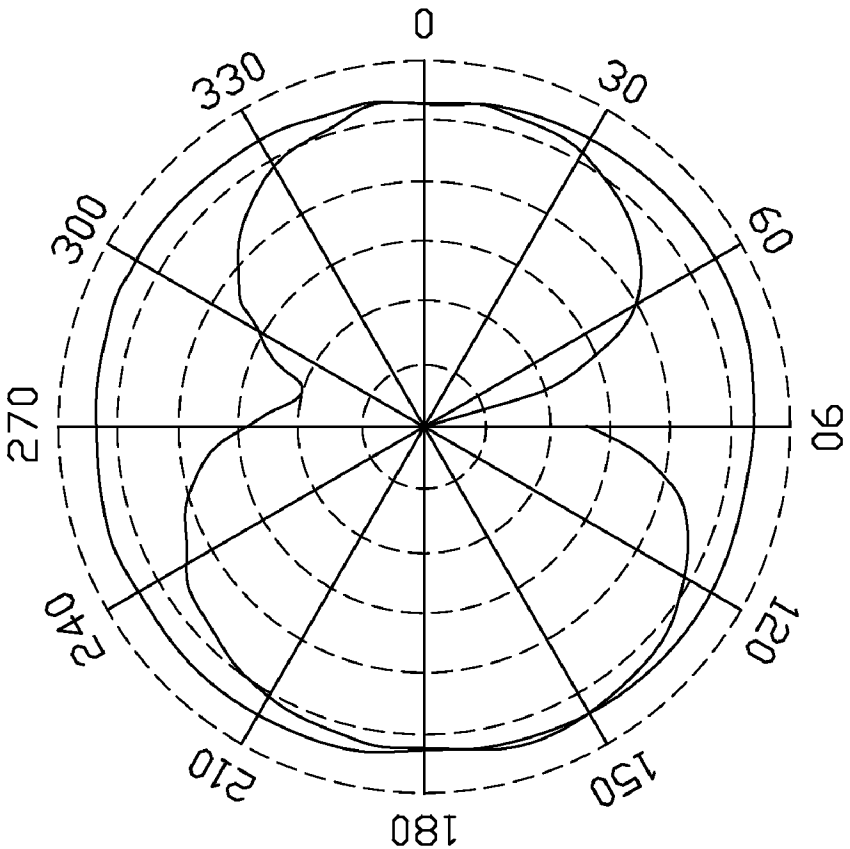
FIG. 4 through FIG. 9 are test charts showing radiation patterns when the antenna of FIG. 1 operates at frequencies of 5.0 GHz, 6.0 GHz, 7.0 GHz, 8.0 GHz, 9.0 GHz, and 10.0 GHz.
Figure 5:
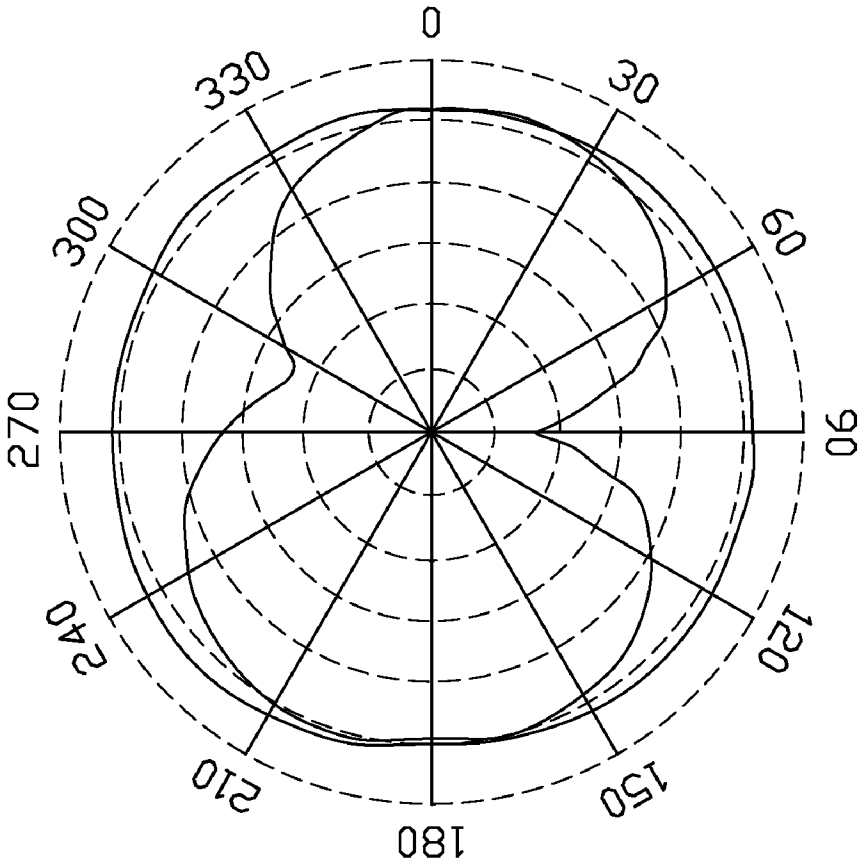
Figure 6:
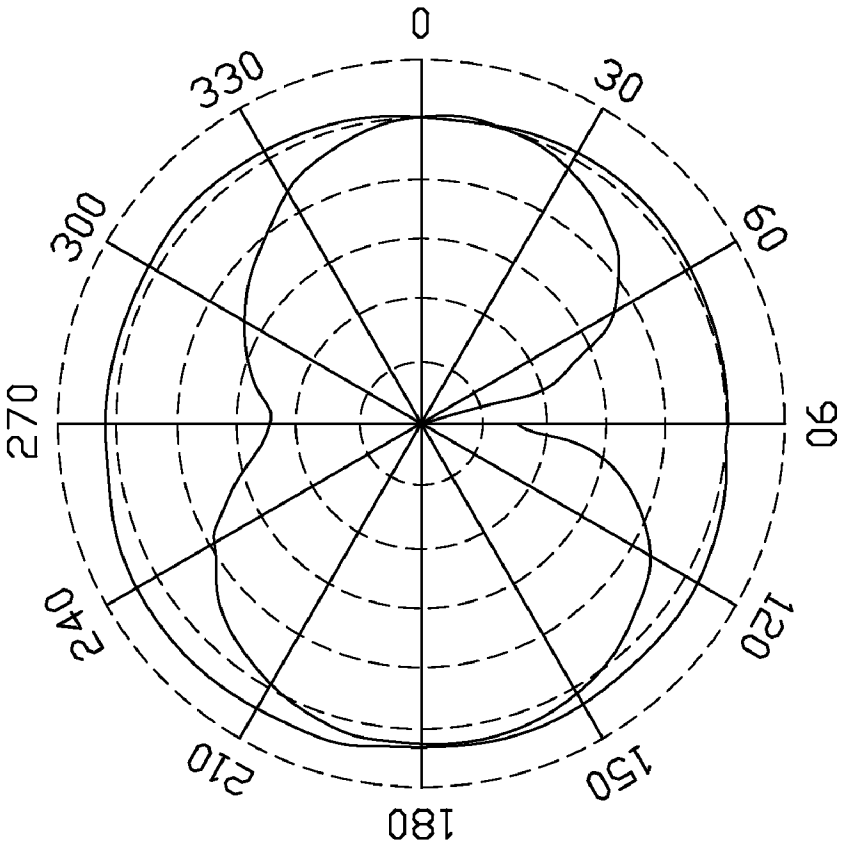
Figure 7:
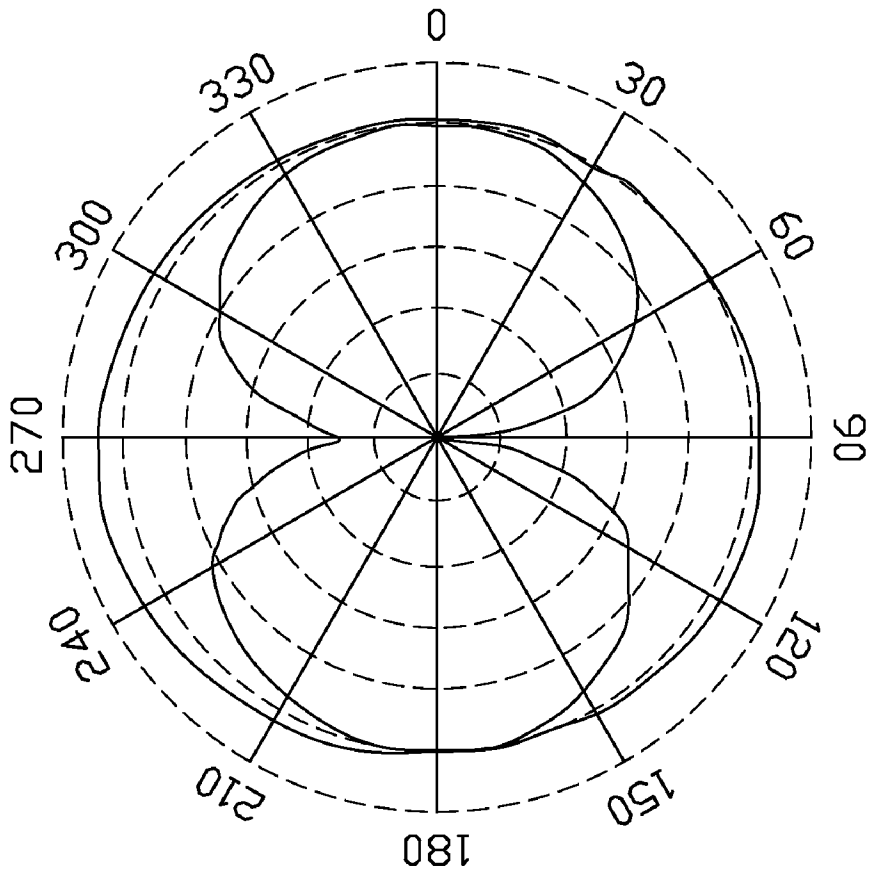
Figure 8:
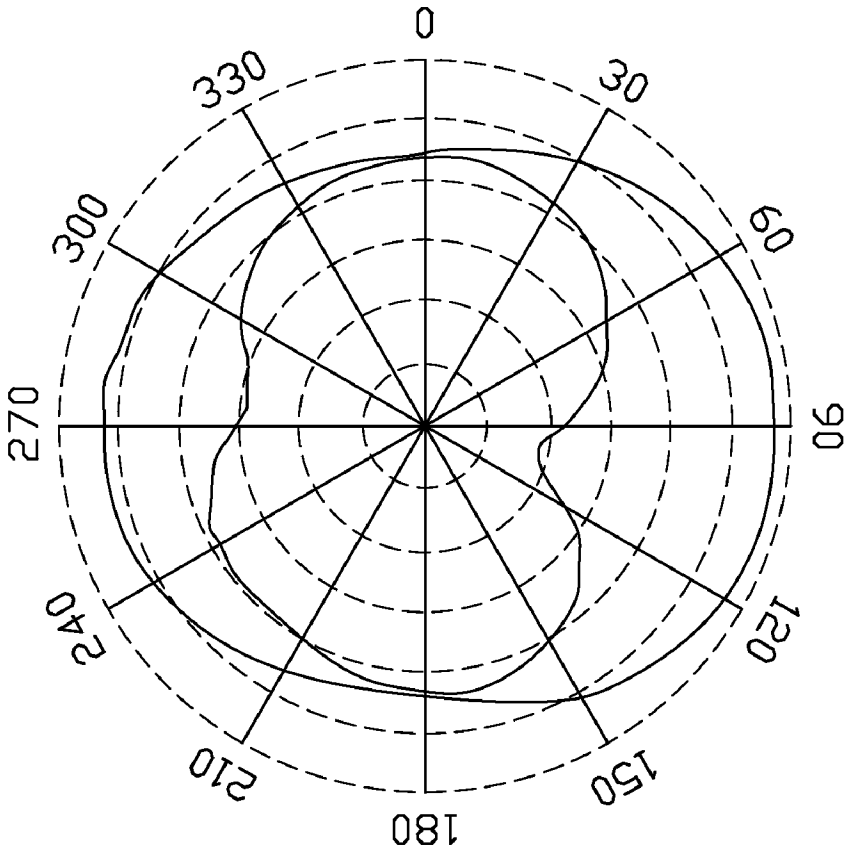
Figure 9:
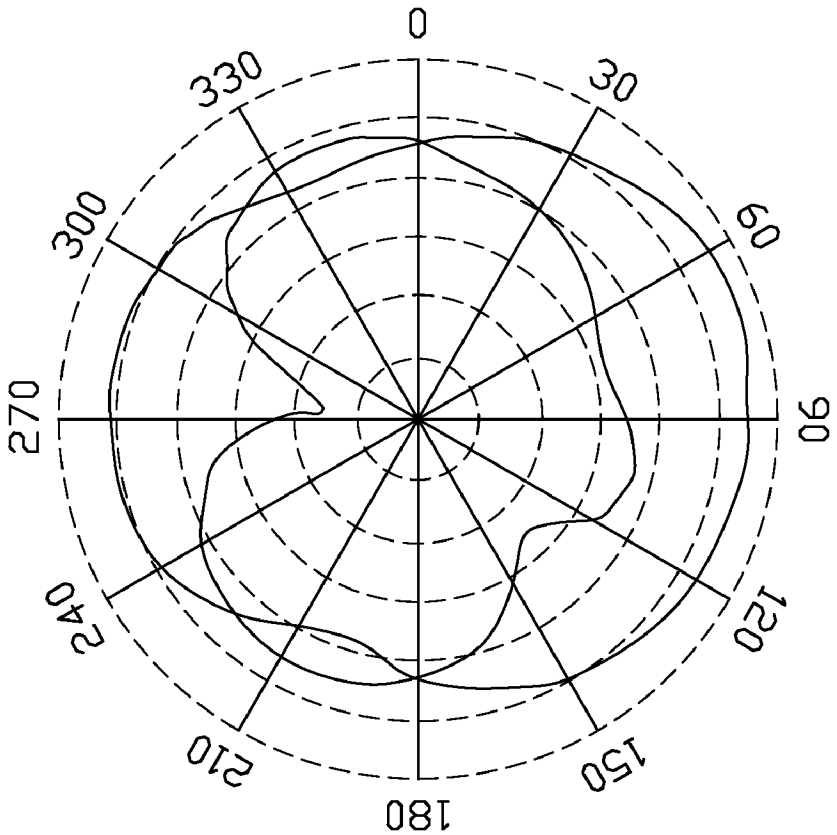

FIG. 3 is a graph showing return loss of the antenna 10. The horizontal axis is frequency, and the vertical axis is amplitude of the return loss.

As shown in FIG. 3, when the antenna 10 operates at frequencies of 5.0 GHz, 6.0 GHz, 7.0 GHz, 8.0 GHz, 9.0 GHz, and 10.0 GHz, the return loss of the antenna 10 is less than −10 dB.

FIG. 4 through FIG. 9 are test charts showing radiation patterns when the antenna 10 operates at frequencies of 5.0 GHz, 6.0 GHz, 7.0 GHz, 8.0 GHz, 9.0 GHz, and 10.0 GHz.

As shown in FIG. 4 through FIG. 9, when the antenna 10 operates at frequencies of 5.0 GHz, 6.0 GHz, 7.0 GHz, 8.0 GHz, 9.0 GHz, and 10.0 GHz, all of the radiation patterns of the antenna 10 are substantially omni-directional.

In this exemplary embodiment, after the electromagnetic signals are transmitted to the fourth transmission line 1426, the electromagnetic signals are divided into two parts by the third transmission line 1424. One part of the electromagnetic signals is transmitted via the first transmission line 1420, and the other part of that is transmitted via the second transmission line 1422. Then both parts of the electromagnetic signals are transmitted to the coupling portion 140 in two opposite directions. Finally, both parts of the electromagnetic signals are fed to the radiator 12 by coupling feeding via the coupling portion 140. Coupling feeding generates more electromagnetic transmission paths than direct feeding. Therefore, the operating frequencies of the antenna 10 are increased. Furthermore, the mazelike structure of the radiator 12 reduces the size of the antenna 10.

Figure 10:
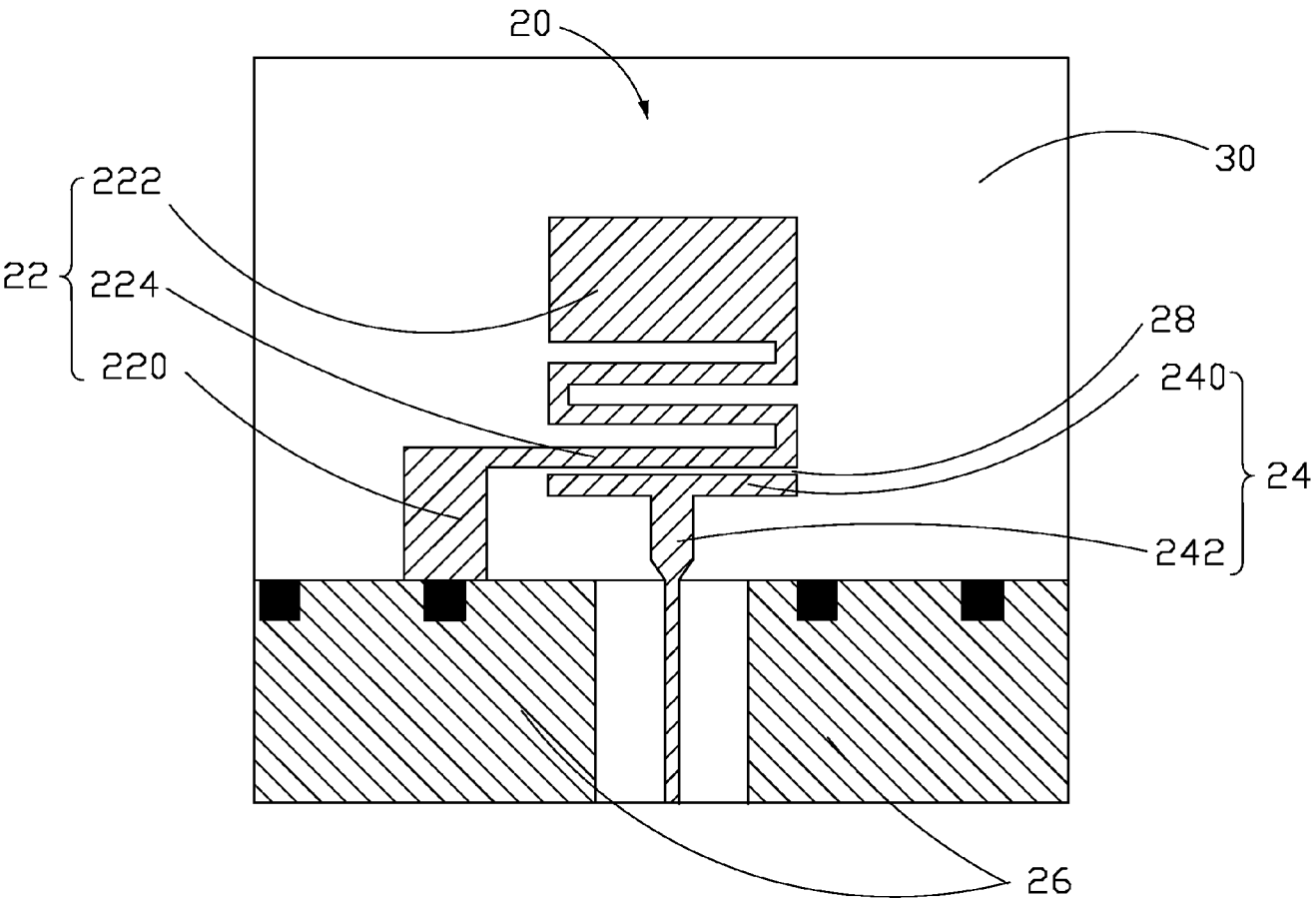
FIG. 10 is a top plan view of an antenna in accordance with another exemplary embodiment of the present invention.

FIG. 10 is a top plan view of an antenna 20 in accordance with another exemplary embodiment of the present invention.

In this embodiment, the antenna 20 is a planar inverted F antenna with coupling feeding, and is printed on a substrate 30 for transceiving electromagnetic signals. The antenna 20 includes a radiator 22, a feeding portion 24, and a grounded portion 26.

The radiator 22 includes a first radiating portion 220, a second radiating portion 222, and a connecting portion 224. The first radiating portion 220 is electronically connected to the grounded portion 26, and the second radiating portion 222 is electronically connected to the first radiating portion 220. The first radiating portion 220, the connecting portion 224, and the second radiating portion 222 are connected end to end in a switchback shape. The feeding portion 24 defines a gap 28 with the radiator 22.

In this exemplary embodiment, the second radiating portion 222 is in a comb line shape, a W shape, an S shape, or a U shape. The feeding portion 24 is used for feeding the electromagnetic signals to the radiator 22 via the gap 28, and includes a coupling portion 240 and a transmission portion 242. The coupling portion 240 is disposed parallel to the connecting portion 224, and defines the gap 28 therewith. The transmission portion 242 is electronically connected to the coupling portion 240. In other exemplary embodiments, the feeding portion 24 can also includes multiple transmission lines for generating many transmission paths.

Figure 11:
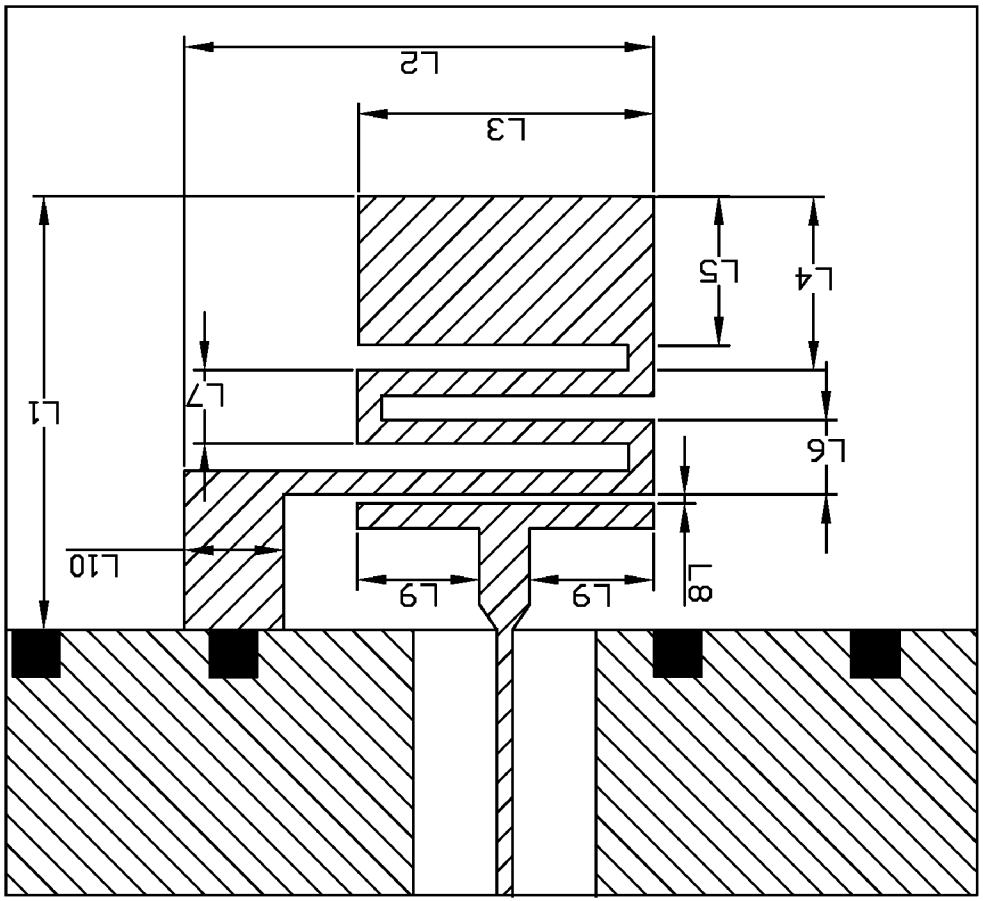
FIG. 11 shows parameters of the antenna of FIG. 10.

FIG. 11 shows parameters of the antenna 20 of FIG. 10.

In the present embodiment, L1, L2, L3, L4, L5, L6, L7, L8 L9, and LI 0 are 8.7 mm, 9.5 mm, 6.0 mm, 3.5 mm, 3.0 mm, 1.5 mm, 1.5 mm, 0.2 mm, 2.5 mm, and 2.0 mm respectively.

Figure 12:
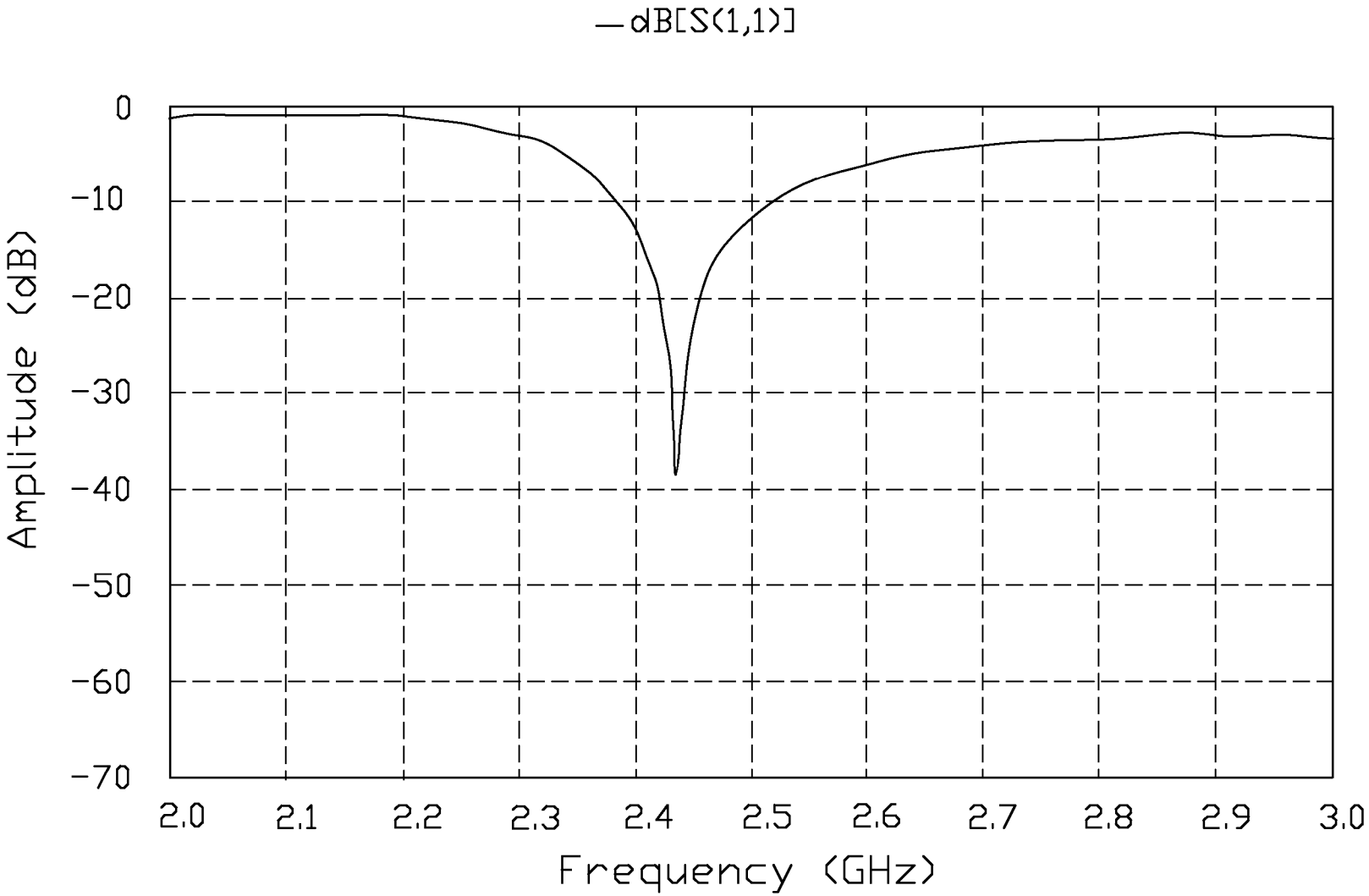
FIG. 12 is a graph showing return loss of the antenna of FIG. 10.

FIG. 12 is a graph showing return loss of the antenna 20. The horizontal axis is frequency, and the vertical axis is amplitude of the return loss.

As shown in FIG. 12, when the antenna 20 operates at a bandwidth of 2.4 GHz~2.5 GHz, the return loss of the antenna 20 is less than −10 dB.

Figure 13:
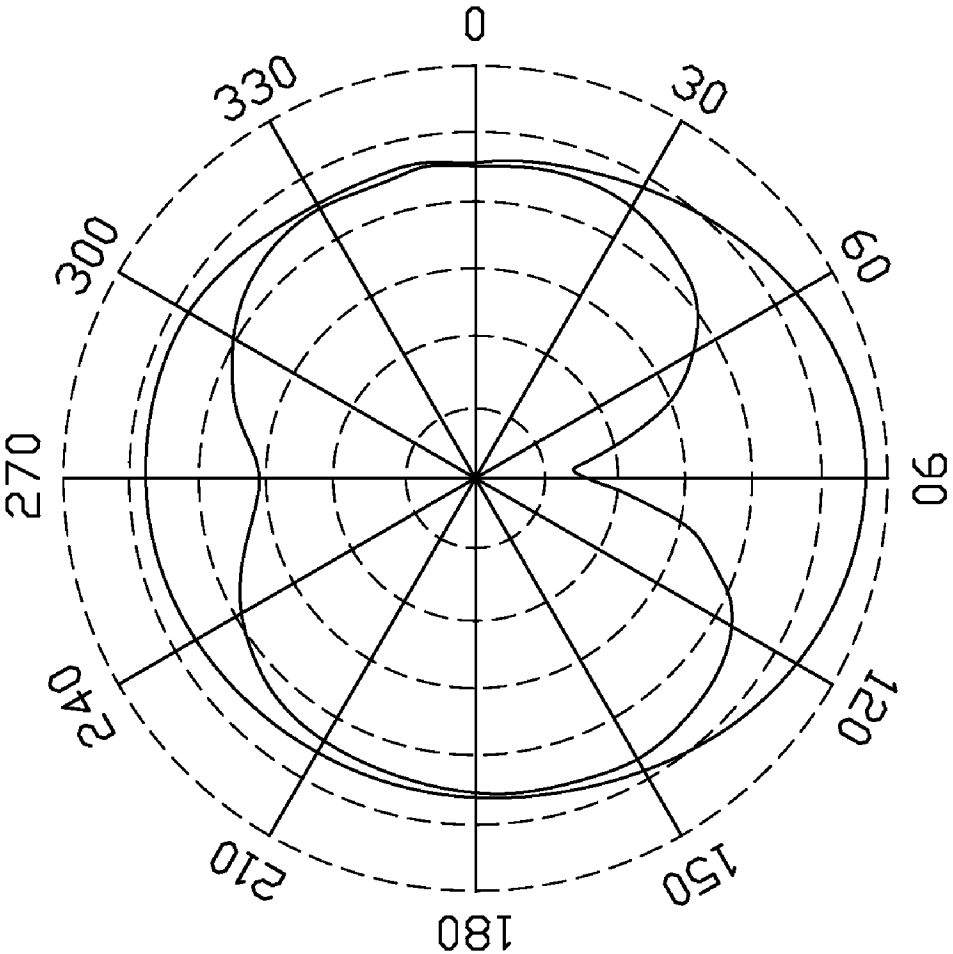
FIG. 13 through FIG. 15 are test charts showing radiation patterns when the antenna of FIG. 10 operates at frequencies of 2.4 GHz, 2.45 GHz, and 2.5 GHz.
Figure 14:
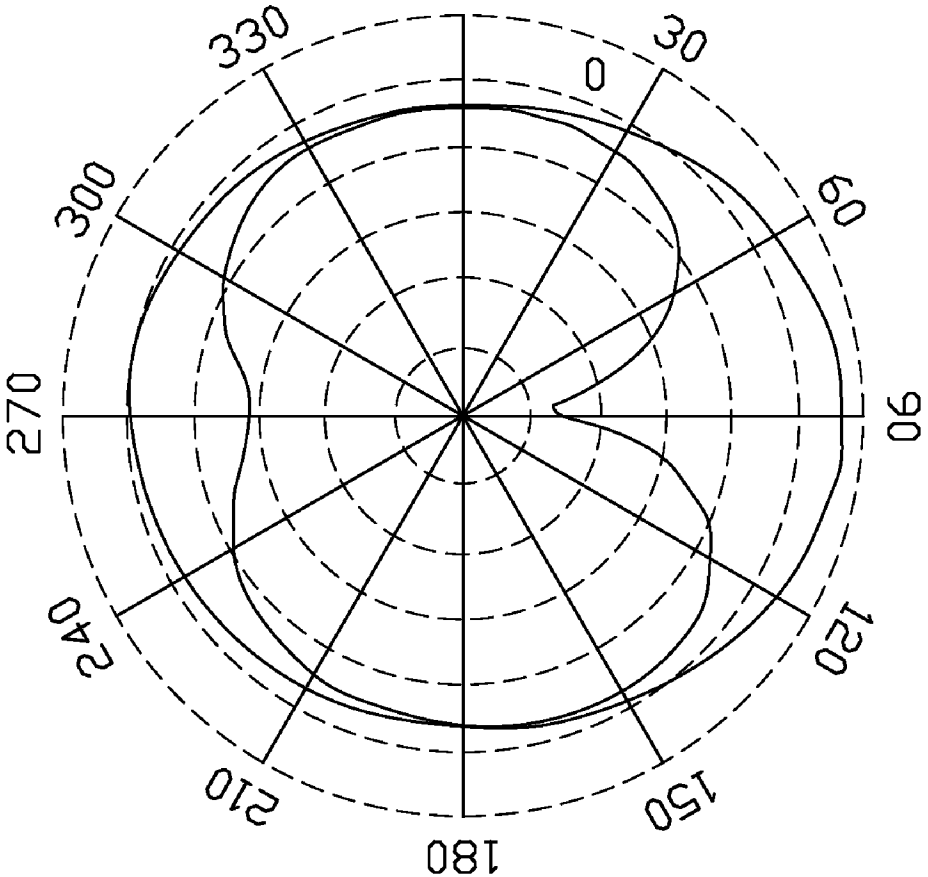
Figure 15:
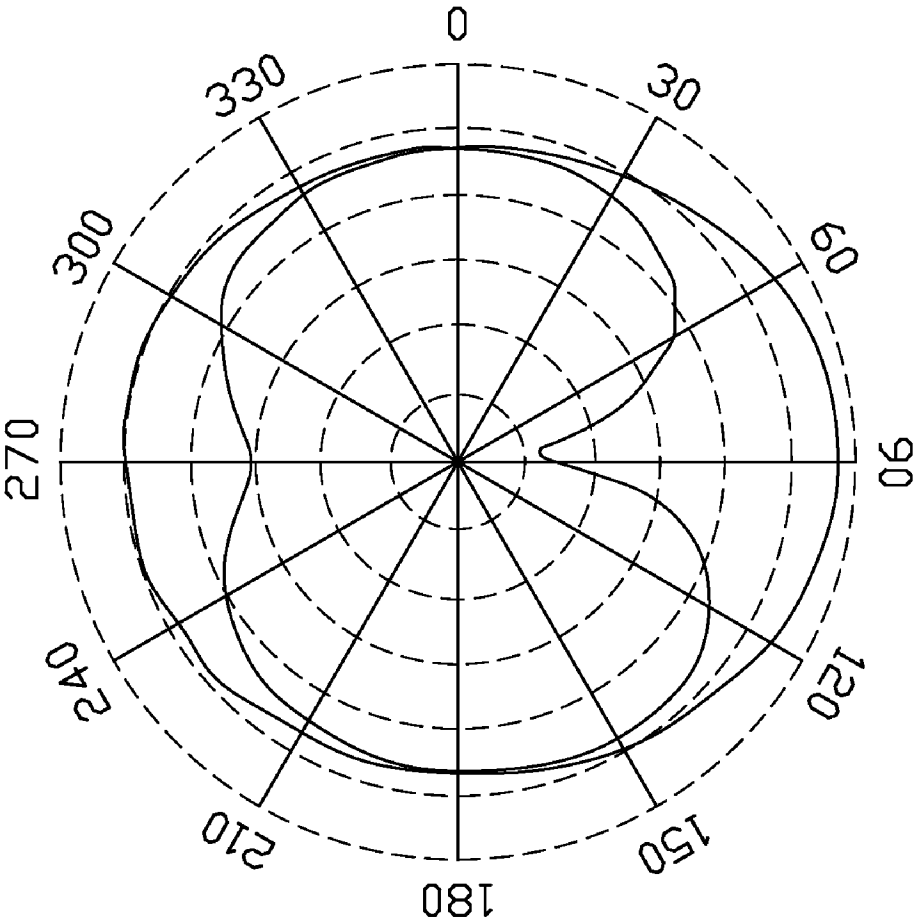

FIG. 13 through FIG. 15 are test charts showing radiation patterns when the antenna 20 operates at frequencies of 2.4 GHz, 2.45 GHz, and 2.5 GHz.

As shown in FIG. 13 through FIG. 15, when the antenna 20 operates at frequencies of 2.4 GHz, 2.45 GHz, and 2.5 GHz, all of the radiation patterns of the antenna 20 are substantially omni-directional.

In this exemplary embodiment, the antenna 20 is a planar inverted F antenna, therefore, the second radiation portion 222 can improve horizontal radiating of the antenna 20. The electromagnetic signals are coupling feeding to the radiator 22 via the coupling portion 240. Coupling feeding generates more electromagnetic transmission paths than direct feeding. Therefore, the operating frequencies of the antenna 20 are increased. Furthermore, the radiator 22 is in the switchback shape, therefore, the size of the antenna 20 is reduced.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An antenna with coupling feeding, printed on a substrate for transceiving electromagnetic signals, the antenna being a monopole antenna and comprising:

a radiator, in a mazelike shape, for transceiving electromagnetic signals;

a feeding portion, defining a gap with the radiator, for coupling feeding the electromagnetic signals to the radiator via the gap, the feeding portion comprising:

a coupling portion, disposed parallel to the radiator and defining a gap therewith; and a transmission portion, electronically connected to the coupling portion, the transmission portion comprising a first transmission line electronically connected to the coupling portion, and a second transmission line electronically connected to the coupling portion and disposed parallel to the first transmission line; and a grounded portion, disposed adjacent to the feeding portion.

2. The antenna as recited in claim 1, wherein the radiator of the monopole antenna is in a helical shape.

3. The antenna as recited in claim 1, wherein the transmission portion further comprises a third transmission line electronically connected to the first transmission line and the second transmission line, and a fourth transmission line electronically connected to the third transmission line and disposed between the grounded portion.

4. An antenna with coupling feeding, printed on a substrate for transceiving electromagnetic signals, the antenna being a planar inverted F antenna and comprising:

a radiator, in a mazelike shape, for transceiving electromagnetic signals;

a feeding portion, defining a gap with the radiator, for coupling feeding the electromagnetic signals to the radiator via the gap; and a grounded portion, disposed adjacent to the feeding portion.

5. The antenna as recited in claim 4, wherein the radiator comprises a first radiating portion electronically connected to the grounded portion.

6. The antenna as recited in claim 5, wherein the radiator further comprises a second radiating portion, and a connecting portion electronically connected to the first radiating portion and the second radiating portion.

7. The antenna as recited in claim 6, wherein the second radiating portion is in a comblike shape, a W shape, an S shape, or a U shape.

8. The antenna as recited in claim 7, wherein the connecting portion is electronically connected to the first radiating portion and the second radiating portion and defines the comblike shape, the W shape, the S shape, or the U shape.

9. An antenna with coupling feeding, printed on a substrate for transceiving electromagnetic signals, comprising:

a radiator, in a mazelike shape, for transceiving electromagnetic signals, comprising:

a first radiating portion, electronically connected to the grounded portion;

a second radiating portion; and a connecting portion electronically connecting the first radiating portion to the second radiating portion;

a feeding portion, defining a gap with the radiator, for coupling feeding the electromagnetic signals to the radiator via the gap, the feeding portion comprising a coupling portion parallel to the connection portion and defining a gap therewith; and a grounded portion, disposed adjacent to the feeding portion.

10. The antenna as recited in claim 9, wherein the feeding portion further comprises a transmission portion connected to the coupling portion.

* * * * *